US005460326A

United States Patent [19]

Albanesius

[11] Patent Number: 5,460,326

[45] Date of Patent: Oct. 24, 1995

[54] ROADSIDE MAIL BOX PROTECTOR

[76] Inventor: Glenn S. Albanesius, 229 Grantville Rd., Winchester, Conn. 06098

[21] Appl. No.: 294,749

[22] Filed: Aug. 23, 1994

[51] Int. Cl.[6] ..... B65D 91/00

[52] U.S. Cl. ..... 232/39; 232/17

[58] Field of Search ..... 232/17, 38, 39, 232/45

[56] References Cited

U.S. PATENT DOCUMENTS

| | | | |
|---|---|---|---|
| 391,293 | 10/1888 | Black | 232/38 |
| 1,204,494 | 11/1916 | Sare | 232/38 |
| 2,552,915 | 5/1951 | Zachrich | 232/39 |
| 2,709,038 | 5/1955 | Marcus | 232/17 |
| 3,107,848 | 10/1963 | Penta . | |
| 4,187,978 | 2/1980 | Dowker | 232/39 |
| 4,368,842 | 1/1983 | DeLange | 232/17 |
| 4,955,533 | 9/1990 | Merkel | 232/39 |
| 5,067,650 | 11/1991 | Jones et al. | 232/17 |
| 5,178,321 | 1/1993 | Majewski | 232/17 |

*Primary Examiner*—Flemming Saether

[57] ABSTRACT

Protective device for a mail box for protection against snow plow debris and vandalism which is made of a strong sheet-like material having a horizontal shelf with preformed apertures for supporting and engaging the mail box and also engaging the ground anchoring member for the mail box. Contiguous to the shelf on one side is a vertically upward shroud facing oncoming traffic and on the other side of a shelf a contiguous downwardly extending skirt is provided. The outer surfaces of the shroud and skirt may have indicia thereon.

15 Claims, 6 Drawing Sheets

Fig. 3A
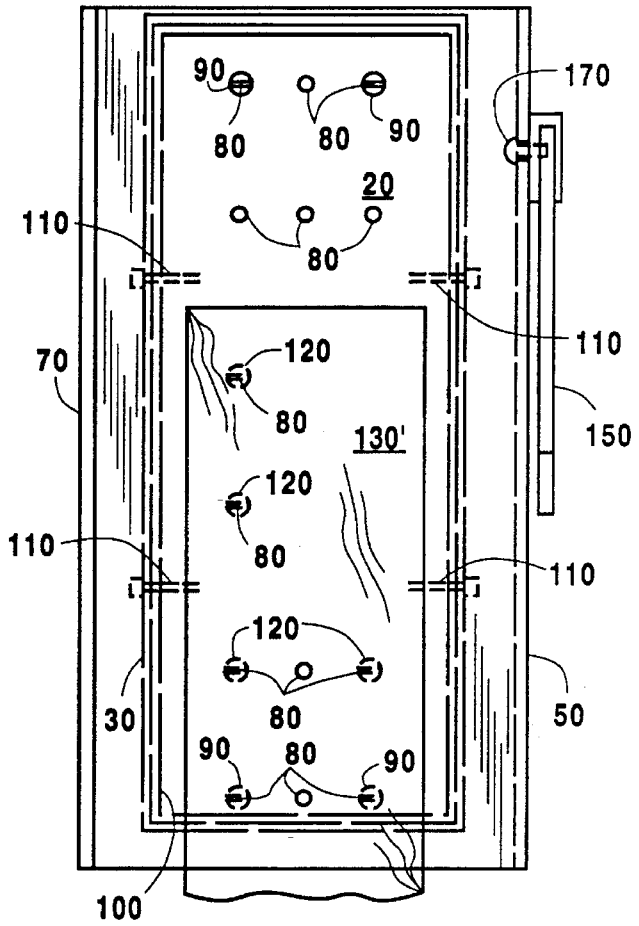
Fig. 6A
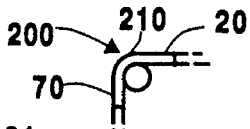
Fig. 6B
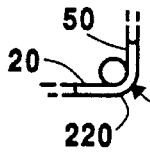
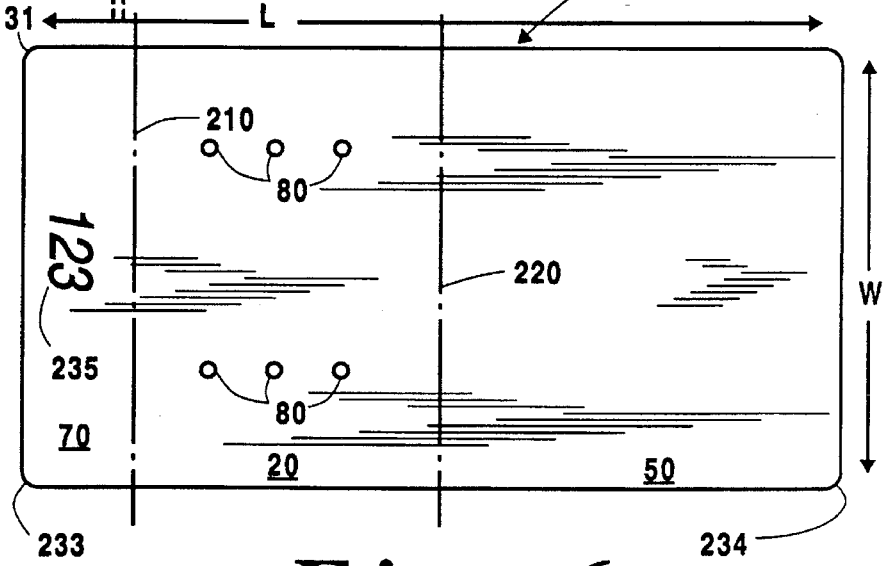
Fig. 6

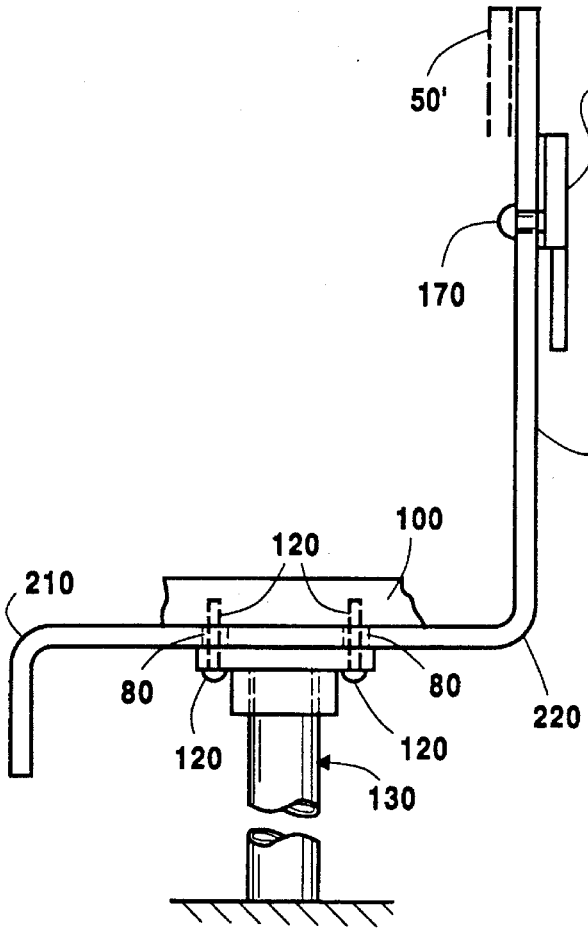
Fig. 4
Fig. 4A
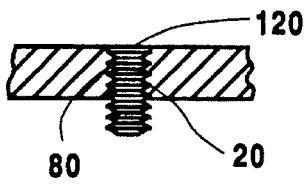
Fig. 4B
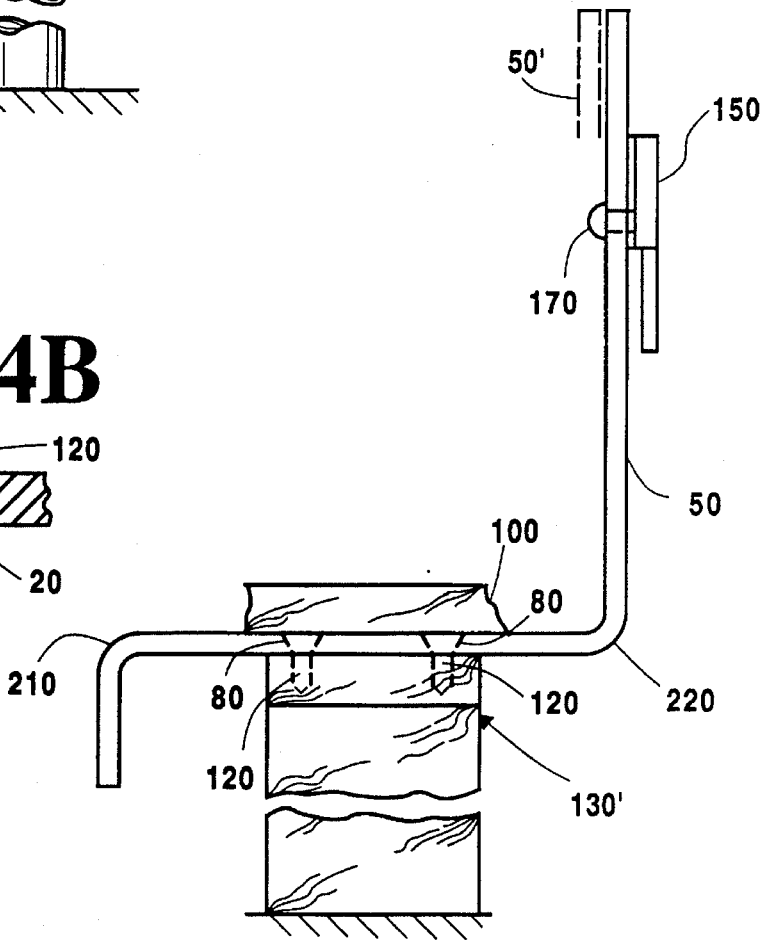

Fig. 7B
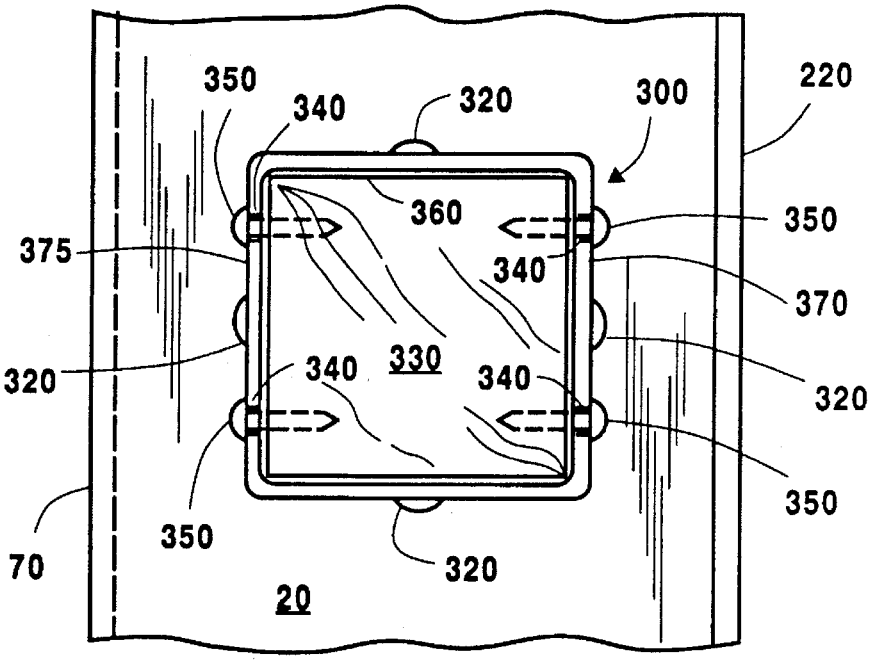
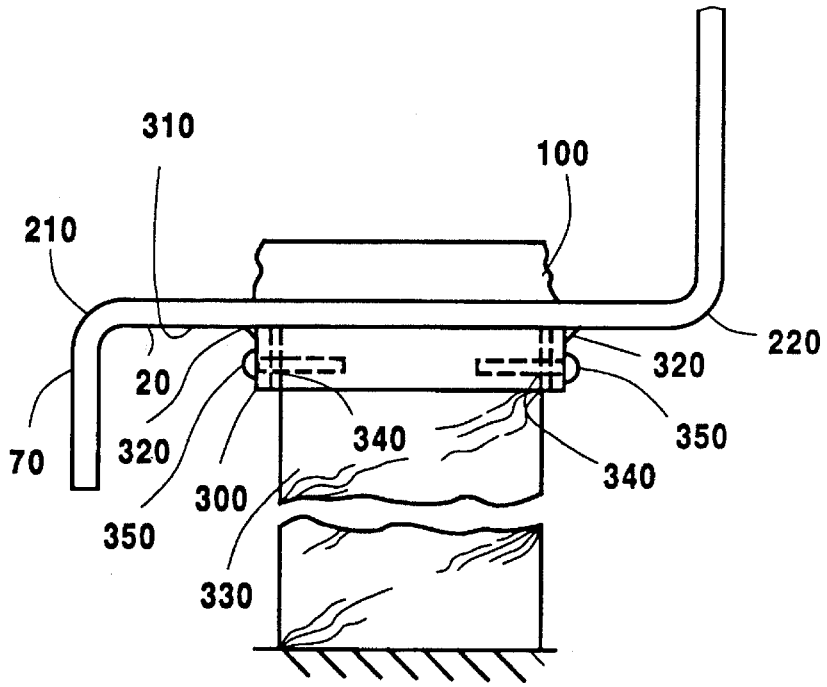
Fig. 7A

ROADSIDE MAIL BOX PROTECTOR

FIELD OF THE INVENTION

This invention relates to a protective device for standard, rural or curb side mail boxes to prevent damage from the impact of snow plow debris and drive-by vandalism.

BACKGROUND OF THE INVENTION

Roadside mail boxes are often damaged by impact of debris, e.g. ice, snow, rocks, sand, and the like, thrown up by snow plows working close to the edge of a road. Also, drive-by vandalism of mail boxes by vandals using clubs and bats to strike the mail boxes off their posts is becoming increasingly common.

U.S. Pat. No. 4,187,978 discloses a flexible shield or cage surrounding a portion of a mail box which utilizes a hinge and shear pin arrangement.

U.S. Pat. No. 4,368,842 discloses a cage formed of spaced apart impact resistant members surrounding a mail box.

U.S. Pat. No. 4,955,533 discloses an arrangement of pipe sections forming a support for a mail box and also a protective arm for deflecting blows from a drive-by vandal.

U.S. Pat. No. 5,067,650 discloses a deformable cover for a mail box which contains a dye or the like.

U.S. Pat. No. 5,178,321 discloses a protective cloth cover for a rural mail box.

SUMMARY OF THE INVENTION

In accordance with the present invention a protective device for a mail box is provided which is relatively inexpensive and can be easily manufactured and installed using conventional equipment, state-of-the-art techniques and material components.

In a preferred embodiment of the invention the protective device is of unitary, i.e. one piece construction and formed of a strong, tough material of high impact resistance and high elastic modulus in order to resist applied forces and absorb energy. The device of the invention has a horizontal shelf portion for supporting a regulation U.S. Postal Service mail box. An upwardly extending shroud portion is provided adjacent the shelf member extending to a height greater than the height of a mail box supported on the shelf. The shroud portion is located such that its outside surface faces oncoming automobile traffic. A downwardly depending skirt portion is provided adjacent the shelf portion and spaced from the shroud portion. A plurality of pre-formed apertures are provided in the shelf member to receive fasteners for securing the mail box to the shelf and for securing the shelf portion to a ground anchoring member.

In a further particularly preferred embodiment of the invention the protective device is formed from a single rectangular piece of strong, tough metal sheet, e.g. rolled steel sheet, aluminum alloy sheet. The sheet is bent in opposite directions along two spaced apart parallel locations in the sheet which are also spaced inwardly from two of the opposed sides of the rectangular sheet. In this manner a shelf portion is formed intermediate the skirt and shroud portions. Apertures are formed in the shelf member and indicia can be placed on the outer surfaces of the skirt and shroud portion.

BRIEF DESCRIPTION OF THE DRAWINGS

FIGS. 3, 3A are bottom plan views of the device of FIG. 1 additionally showing means for securing the same to a ground anchor;

FIGS. 4, 4A are front elevation views of the device of FIGS. 3, 3A;

FIG. 4B shows a fastener engagement for the device of FIG. 3;

FIGS. 6, 6A, 6B illustrate a procedure for making the protective device of FIG. 1;

FIG. 7A, 7B are respectively fragmented front elevation and bottom views of the device of FIG. 7.

DETAILED DESCRIPTION OF THE INVENTION

Figure 1:
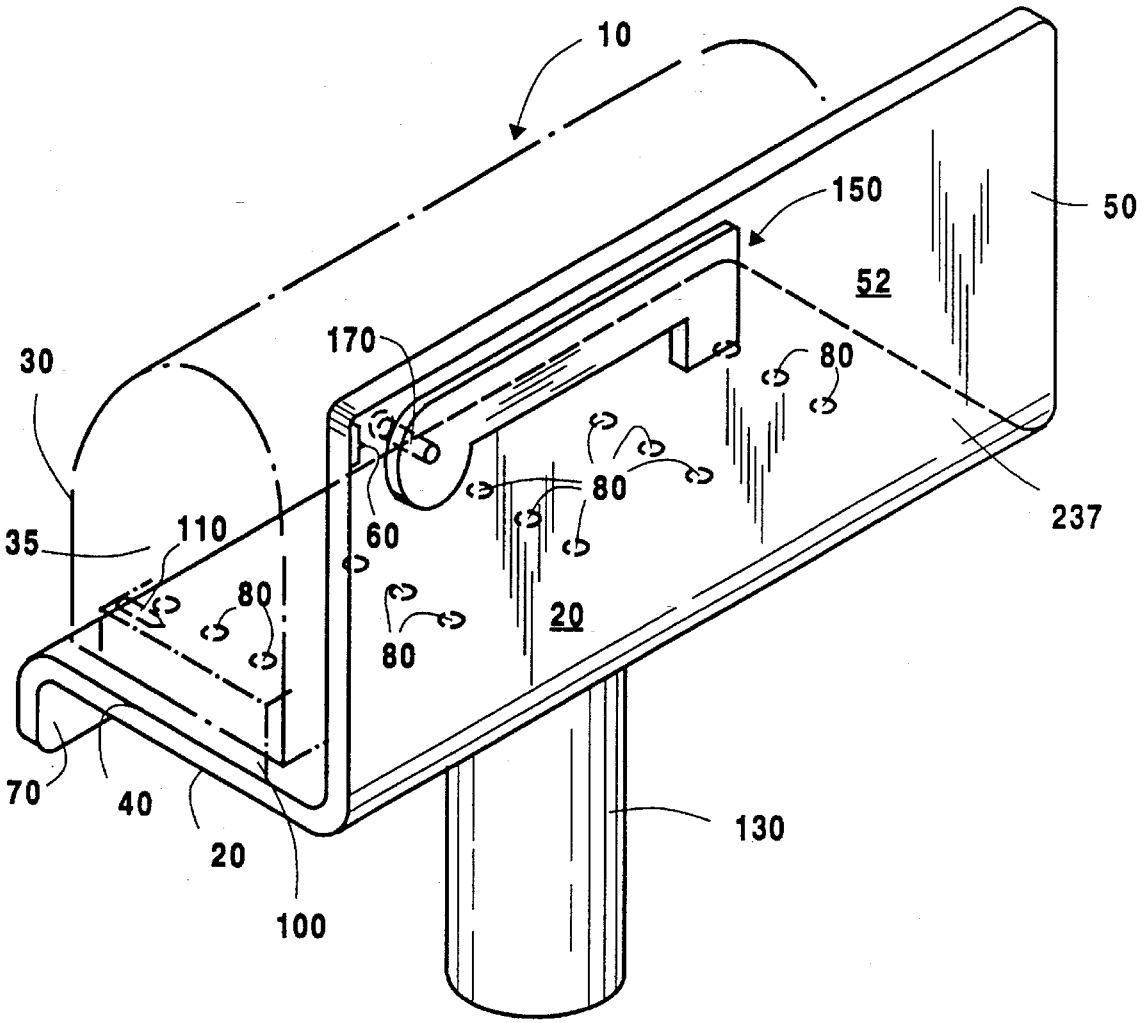
FIG. 1 is a perspective view of a mail box protective device in accordance with the present invention.
Figure 2:
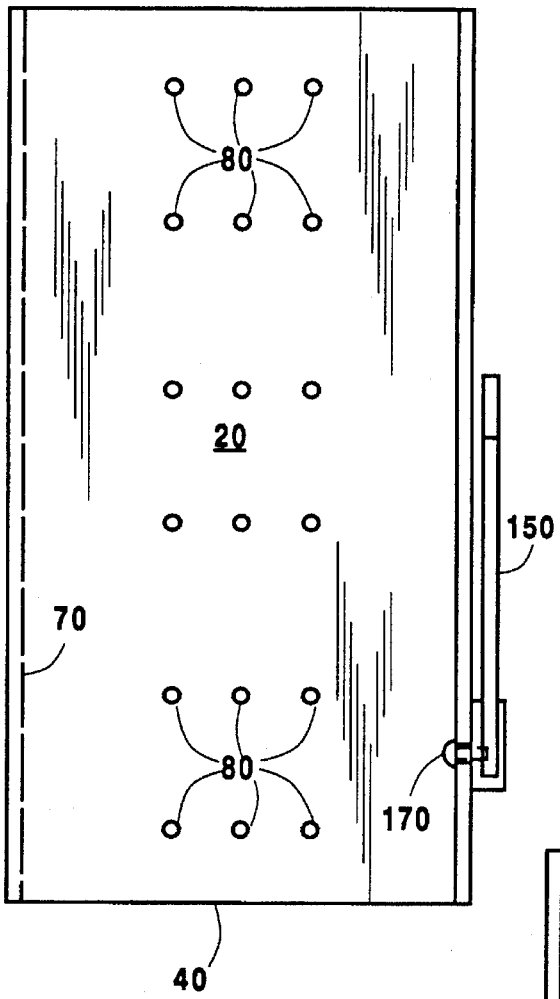
FIG. 2 is a top plan view of the device of FIG. 1.
Figure 3:
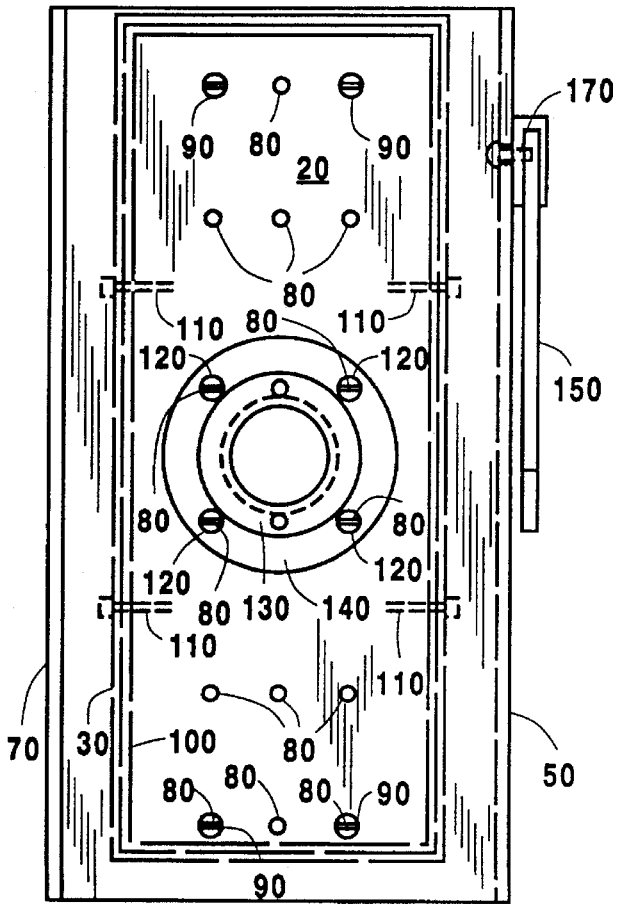
Figure 5:
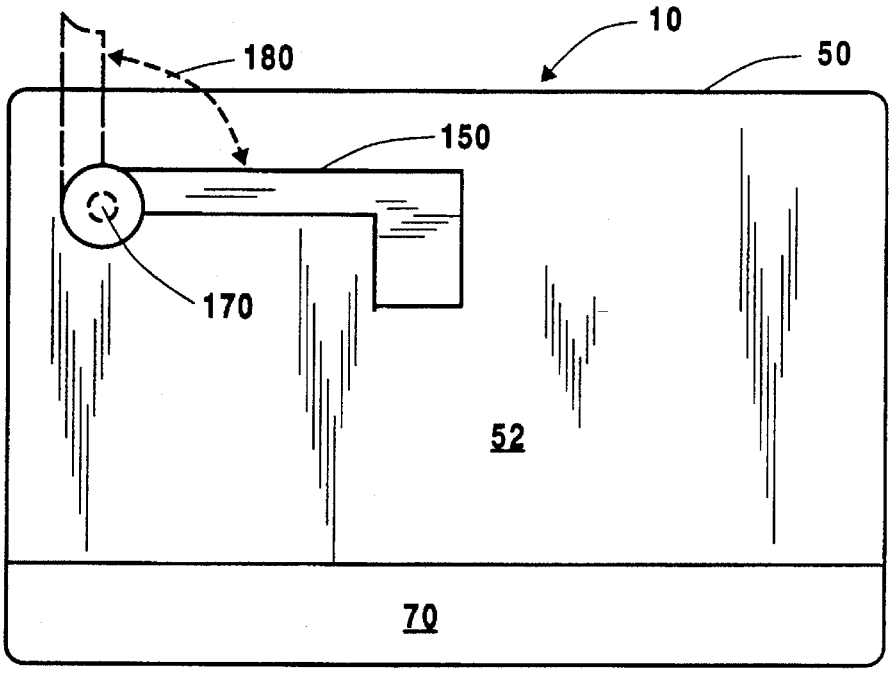
FIG. 5 is a side elevation view of the device of FIG. 1 showing the outside surface of the shroud portion.

With reference to the perspective view of FIG. 1, a protective device for a mail box in accordance with the present invention is shown at 10 having a horizontal shelf portion 20 for supporting a regulation U.S. Postal Service mail box, shown in phantom at 30 which can extend flush with the forward edge 40 of shelf portion 20. An upwardly vertically extending shroud portion 50 extends to a level above the top of the mail box 30, as shown at 60, this distance being suitably about ¾ inch to 3 inches. A skirt portion 70 extends vertically downward, oppositely to shroud 50, a fraction of the height of the shroud 50 e.g. ⅕ to ⅓ the height of shroud 50. The shelf portion 20 is provided with pre-formed apertures 80, shown more clearly in the top view of FIG. 2, to receive fastening elements 90, shown in the bottom view of FIG. 3 to secure the mail box 30 to shelf portion 20, e.g. by way of a wooden base block 100 which is typically attached to the sides of mail box 30 by nails or screws 110. Other of the apertures 80 receive fasteners 120 to secure the shelf portion 20 to a metal ground anchoring member 130 by way of its flange 134 as shown in FIG. 3 and FIG. 4. Anchoring member 130 can alternatively be a wooden post, or a wooden arm 130' as is common usage as shown in FIGS. 3A and 4A. It is advantageous to have fasteners 120 threadably engage shelf portion 20 as shown in FIG. 4C. The protective device 10 can be provided with a conventional indicator flag 150 on the outside surface 52 of shroud portion 50 which faces oncoming automobile traffic (right side). Flag indicator 150 is pivotally mounted to shroud portion 50 at 170 and can be rotated from a horizontal to vertical position as shown at 180 in FIG. 5.

A specific embodiment of the present invention is formed from a sheet of rolled steel, shown at 200 in FIG. 6, suitably ⅛ inch thick, 22 inches long (l) by 20 inches wide (w). The steel sheet is subjected to bending at two spaced apart locations 210, 220 which are parallel to each other and to the sides "w" and transverse to sides "l". The bend is formed by plastic deformation of sheet 200 as shown in FIGS. 6A, 6B with a curve radius suitably of 7/16 inch e.g. in the range of 5/16 to 9/16 inch.

The corners 231–234 of steel sheet 200 are rounded, suitably in the course of shearing or punching, and these corners and all edges of steel strip 250 are ground to eliminate any sharp edges or corners on the protective device of the invention. As shown in FIG. 6, indicia 235, such as a street address can be applied to skirt 70, and also shroud 50 as shown at 237 in FIG. 1.

With mail box 30 secured to shelf 20, and shelf 20 secured to a ground anchor 130, protective device 10 acts somewhat in the manner of a leaf spring when the outside surface 52 of shroud 50 is struck by snow plow debris or an implement and resiliently deforms about curved bend location 220, e.g. it deflects slightly inward, indicated at 50' in FIG. 4 and then returns to its original position 50, absorbing the energy from the impact of plow debris or implement. The mail box 30 is spaced from shroud 50 and skirt 70 by about ½ to 1¼ inches and thus is not directly subject to the impact energy applied to shroud 50, which is almost entirely absorbed by the unitary device comprising shroud 50, shelf 20 and skirt 70. The mail box 30 is preferably mounted on shelf 20 with its front surface 35 flush with the forward edge 40 of shelf 20. The skirt 70 is suitable for the application of indicia as noted hereinabove and also serves to drain away liquid, such as rain or melted ice, from shelf 20, due to the downwardly curved bend 210 which drains away the liquid in the same way as a sinkboard drain, i.e. due to surface tension of the liquid.

In the protective device of the present invention, no sharp corners or edges are presented to the user or installer of the device and virtually complete protection from plow debris or drive-by vandalism is provided for the mail box.

Under certain strenuous conditions cold rolled steel sheet is the preferred material for the protective device due to its ruggedness and high impact resistance and modulus of elasticity. Other materials can be used such as aluminum alloy sheet or castings, and molded or extruded engineering plastic polymeric materials such as thermoplastic and thermosetting resins which contain fibers, such as glass, aramid and carbon fibers for reinforcement. Polysulfone and polycarbonate can be used. The Modern Plastics Encyclopedia published annually by McGraw-Hill Inc. provides an identification of engineering plastics with their mechanical properties, e.g. strength and toughness, so that a material can be selected on the basis of the severity of conditions to which a mail box may be exposed. The October, 1986 Volume 63, Number 10A lists a number of commercially available materials. Those materials suitable for the manufacture of canoes and skis are generally suitable. The sheet-like device of the present invention is suitably from 3/32 to 3/8 inch thick, the thinner dimensions being appropriate for metals and thicker dimensions being used for polymeric materials.

Figure 7:
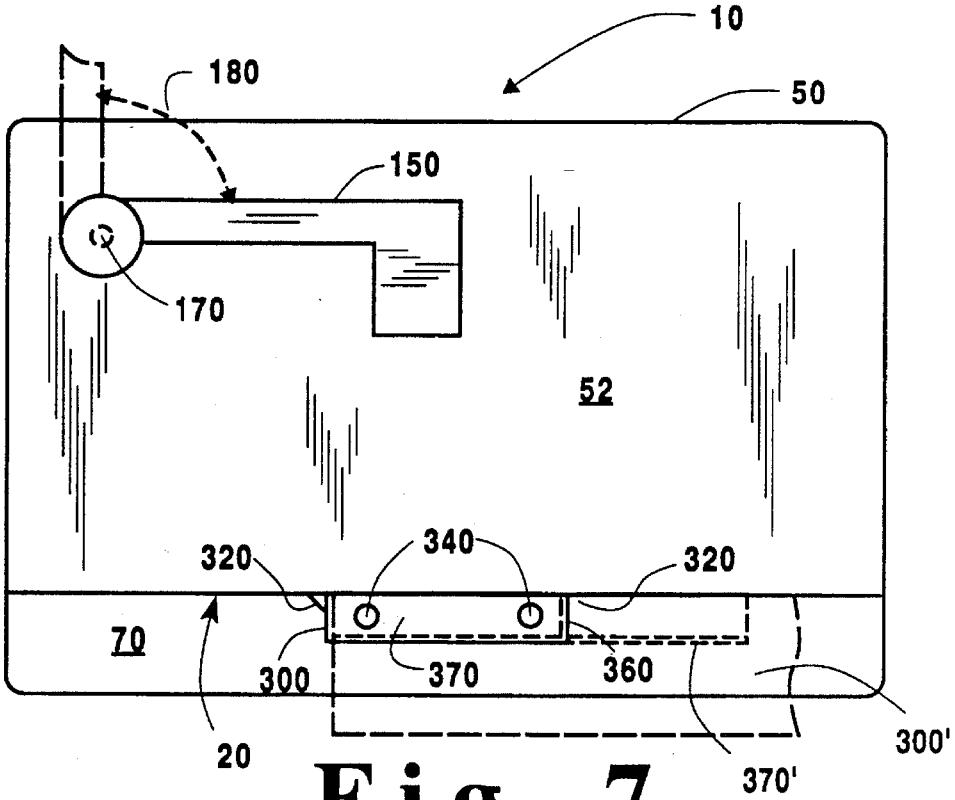
FIG. 7 shows an embodiment of the present invention which is provided with a cap element for receiving an anchoring element.

A further embodiment of the present invention is shown in FIGS. 7, 7A, 7B.

With reference to FIG. 7, 7A, 7B, shelf portion 20 is provided with a cap member 300 which is fixed to the bottom 310 of shelf portion 20, e.g. by welds 320, or by molding when the device 10 is made of plastic. Cap member 300 is suitably in the form of a sleeve of square cross-section as shown in FIG. 7B to receive an anchoring element in the form of a post of pressure-treated wood having a square cross-section, e.g. 6 inch×6 inch as shown at 330. Apertures 340 receive fastener elements, e.g. screws 350, to affix the post 330 to the protective device 10. With reference to FIG. 7, by eliminating the back wall 360 of cap member 300 and extending side walls 370, 375, the cap member can receive a horizontal extension 300' of the anchoring element.

What is claimed is:

1. Protective device of unitary one-piece construction in combination with a mail box supported by an underlying ground anchoring member, said protective device having a horizontal shelf portion for supporting the mail box, an upwardly extending shroud portion contiguous to said shelf portion having a height greater than that of the mail box, said shroud portion having an outer surface adapted to face oncoming automobile traffic, and a downwardly depending skirt portion contiguous to said shelf member being spaced from said shroud portion and joined to said shelf member by a downwardly curved bend for draining away liquid such as rain or melted ice from said shelf member, said horizontal shelf member having an array of preformed apertures which receive fastening elements to secure the bottom of the mail box to the shelf member and to secure the shelf member to the underlying anchoring member.

2. Combination in accordance with claim 1 wherein said protective device is in the form of a sheet of steel which was subjected to plastic deformation by bending at two spaced apart bend locations to form the shroud and skirt formation.

3. Combination in accordance with claim 1 wherein said protective device is formed of a sheet of aluminum alloy which was subjected to plastic deformation by bending at two spaced apart bend locations to form the shroud and skirt formation.

4. Combination in accordance with claim 1 wherein said protective device of unitary one-piece construction is in the form of sheet-like material comprising a polymeric thermoplastic or thermosetting resin.

5. Combination in accordance with claim 1 wherein said protective device is sheet-like in form having a thickness of between 3/32 and 3/8 inch.

6. Combination in accordance with claim 1 wherein indicia is provided on the outer surface of said shroud portion.

7. Combination in accordance with claim 1 wherein said skirt portion has an outer surface with indicia provided thereon.

8. Combination in accordance with claim 1 wherein the contiguous shelf and shroud portions of the unitary one-piece protective device meet at an upwardly curved contiguous region and the contiguous shelf and skirt portions of the unitary one-piece protective device meet at a downwardly curved contiguous region.

9. Protective device of unitary one-piece construction for a mail box in the form of a bent metal sheet having a spaced apart pair of oppositely directed curved bends and a vertically downwardly depending skirt element extending from one of said curved bends of said pair and a vertically upwardly extending shroud element extending from the other curved bend of said pair, said skirt element and said shroud element being separated by a horizontal shelf member, said horizontal shelf member having an array of preformed apertures for receiving fastening elements to secure the bottom of a mail box to the shelf member and for securing the shelf member to an underlying anchoring member, said shelf member having dimensions such that a mail box can be supported thereon along its full length and width while being spaced from said skirt and shroud elements, said shroud element having an outer surface adapted to face oncoming traffic and extending upwardly to a height greater than that of a mail box supported on said shelf member and said skirt member extending downwardly a distance which is a fraction of the height of said mail box.

10. Protective device of unitary one-piece construction for a mail box in the form of a bent rectangular sheet of rolled steel having a spaced apart pair of oppositely directed curved bends and a vertically downwardly depending skirt element extending from one of said curved bends of said pair and a vertically upwardly extending shroud element extending from the other curved bend of said pair, said skirt element and said shroud element being separated by a horizontal shelf member, said horizontal shelf member having an array of pre-formed apertures for receiving fastening elements for securing the bottom of a mail box to the shelf member and for securing the shelf member to an underlying anchoring member, said shelf member having dimensions such that a mail box can be supported thereon along its full length and width while being spaced from said skirt and shroud elements, said shroud element having an outer surface adapted to face oncoming traffic and extending upwardly to a height greater than that of a mail box supported on said shelf member and said skirt member extending downwardly a distance which is a fraction of the height of said mail box said shroud member having a flag indicator pivotally engaged thereto and rotatable from a horizontal to vertical position.

11. Protective device in accordance with claim 10 having a cap member in combination therewith extending downward from the shelf member and an anchoring member closely fitted within said cap member.

12. Protective device in accordance with claim 11 wherein said cap member is provided with apertures for receiving fasteners for engagement with said anchoring member.

13. Protective device in accordance with claim 12 wherein said cap member is in the form of a sleeve.

14. Protective device in accordance with claim 13 wherein said sleeve has a square cross-section to receive a wooden anchoring member in the form of a post having a square cross-section.

15. Protective device in accordance with claim 13 wherein said sleeve is open at one side to receive a horizontal extension of an anchoring member.

* * * * *